US009038730B2

(12) United States Patent
Smith

(10) Patent No.: US 9,038,730 B2
(45) Date of Patent: May 26, 2015

(54) MARINE RISER ADJUSTABLE BUOYANCY MODULES

(75) Inventor: Ron Smith, Houston, TX (US)

(73) Assignee: Deep Down, Inc., Channelview, TX (US)

( * ) Notice: Subject to any disclaimer, the term of this patent is extended or adjusted under 35 U.S.C. 154(b) by 460 days.

(21) Appl. No.: 13/436,105

(22) Filed: Mar. 30, 2012

(65) Prior Publication Data

US 2012/0247782 A1 Oct. 4, 2012

Related U.S. Application Data

(60) Provisional application No. 61/470,043, filed on Mar. 31, 2011.

(51) Int. Cl.
*E21B 7/12* (2006.01)
*E21B 17/01* (2006.01)

(52) U.S. Cl.
CPC ..... *E21B 17/012* (2013.01)

(58) Field of Classification Search
CPC ..... E21B 17/012
USPC ..... 166/350, 367; 441/133
See application file for complete search history.

(56) References Cited

U.S. PATENT DOCUMENTS

| | | | | | |
|---|---|---|---|---|---|
| 3,858,401 | A * | 1/1975 | Watkins | 405/224.2 |
| 3,992,889 | A * | 11/1976 | Watkins et al. | 405/224.2 |
| 4,098,333 | A * | 7/1978 | Wells et al. | 166/352 |
| 4,099,560 | A * | 7/1978 | Fischer et al. | 166/350 |
| 4,249,610 | A * | 2/1981 | Loland | 166/360 |
| 4,477,207 | A * | 10/1984 | Johnson | 405/195.1 |
| 4,636,114 | A * | 1/1987 | Hale | 405/223.1 |
| 4,646,840 | A * | 3/1987 | Bartholomew et al. | 166/350 |
| 4,657,439 | A * | 4/1987 | Petersen | 405/200 |
| 5,088,859 | A * | 2/1992 | Devlin | 405/211 |
| 6,004,074 | A * | 12/1999 | Shanks, II | 405/195.1 |
| 6,402,430 | B1 * | 6/2002 | Guesnon | 405/224.2 |
| 7,008,141 | B2 * | 3/2006 | Fitzgerald et al. | 405/224.2 |
| 7,059,416 | B2 * | 6/2006 | Dailey et al. | 166/359 |
| 7,210,531 | B2 * | 5/2007 | van Belkom et al. | 166/367 |
| 8,074,720 | B2 * | 12/2011 | Radi | 166/350 |

* cited by examiner

*Primary Examiner* — Matthew Buck
*Assistant Examiner* — Aaron Lembo
(74) *Attorney, Agent, or Firm* — Osha Liang LLP

(57) ABSTRACT

A marine riser includes one or more buoyancy modules running along a length of the marine riser, wherein the one or more buoyancy modules are molded such that an umbilical may be secured along a length of the one or more buoyancy modules.

20 Claims, 2 Drawing Sheets

MARINE RISER ADJUSTABLE BUOYANCY MODULES

CROSS REFERENCE TO RELATED APPLICATIONS

This application claims the priority of a provisional application under 35 U.S.C. §119(e), namely U.S. Patent Application Ser. No. 61/470,043 filed on Mar. 31, 2011, which is incorporated by reference in its entirety herein.

BACKGROUND

1. Field of the Disclosure

Embodiments disclosed herein relate generally to marine riser buoyancy modules. In particular, embodiments disclosed herein relate to a riser buoyancy module system providing buoyancy to a riser and platform while providing a conduit for a number of intelligent downhole services.

2. Background Art

Offshore oil and natural gas drilling and production, particularly in deep water, relies on substantially vertical conduits called "marine risers" to convey fluids and slurries between the seabed and the surface, including but not limited to, drilling risers, production risers, export risers, steel catenary risers ("SCRs"), and flexible composite flowlines.

Some marine risers, such as SCRs, may include a single conduit, while other risers, such as drilling risers, may include a larger diameter main conduit with a plurality of attached, smaller diameter auxiliary lines, including but not limited to, choke and kill lines, "boost" lines, and hydraulic supply and control lines. In some cases, electrical or fiber optic control umbilicals may also be attached to the main conduit of the marine riser.

Typically a marine riser may be at least partially supported by floatation of one form or another, including for example evacuated buoyancy "cans" or buoyancy modules made from, for example, syntactic foam material. Buoyancy modules may be arranged circumferentially around the main conduit of a marine riser. Marine drilling risers, for example, typically have syntactic foam buoyancy modules, each including two "clamshell" longitudinal half-cylinder buoyancy elements that are clamped around the main conduit, and which have molded-in grooves, recesses and holes to accommodate attachment hardware and auxiliary lines.

To compensate for stress and fatigue along a length of the riser, a wall thickness of the riser in certain areas is often increased to strengthen the riser, causing it to be heavier and more expensive. In addition, a riser monitoring system ("RMS") may be installed onto the riser to monitor stress points along a length thereof. These installations are typically separate umbilicals laid on the seafloor from an existing subsea umbilical termination assembly ("SUTA") and require additional SUTAs and flying leads to run over and attach to the riser monitoring sensors. The flying leads are often equipped with floatation devices and secured to the riser to prevent the flying leads from being crushed on the sea floor. However, this system may be prone to snagging a line on a subsea object, thus rendering the system inoperable. In addition, these additional systems that connect to the riser monitoring systems increase the clutter on the sea floor. Further, the riser monitor sensors are permanently installed items, and thus, often are unable to be serviced. Still further, acoustic Doppler current profile ("ADCP") systems may be required to record current along a length of the riser. ADCP systems may require free standing buoys connected by expensive electrical umbilicals along with additional umbilicals, terminations, sleds and flying leads, which lie along the sea floor taking up valuable real estate and costing top dollar for the installation of the systems.

Accordingly, there exists a need for a riser system capable of combining and securing a number of monitoring systems while providing a base line of buoyancy to the entire riser and platform.

SUMMARY OF THE DISCLOSURE

In one aspect, embodiments disclosed herein relate to a marine riser including one or more buoyancy modules running along a length of the marine riser, wherein the one or more buoyancy modules are molded such that an umbilical may be secured along a length of the one or more buoyancy modules.

In other aspects, embodiments disclosed herein relate to a buoyancy module installed on a riser, the module including an outer buoyant shell, one or more inner chambers within the outer buoyant shell, and a supply valve configured to allow air and water to enter the one or more inner chambers.

In other aspects, embodiments disclosed herein relate to a method including installing one or more buoyancy modules along a length of a subsea riser and providing communication to one or more downhole components installed on the one or more buoyancy modules through an umbilical running along a length of the one or more buoyancy modules.

Other aspects and advantages of the invention will be apparent from the following description and the appended claims.

DETAILED DESCRIPTION

Figure 1:
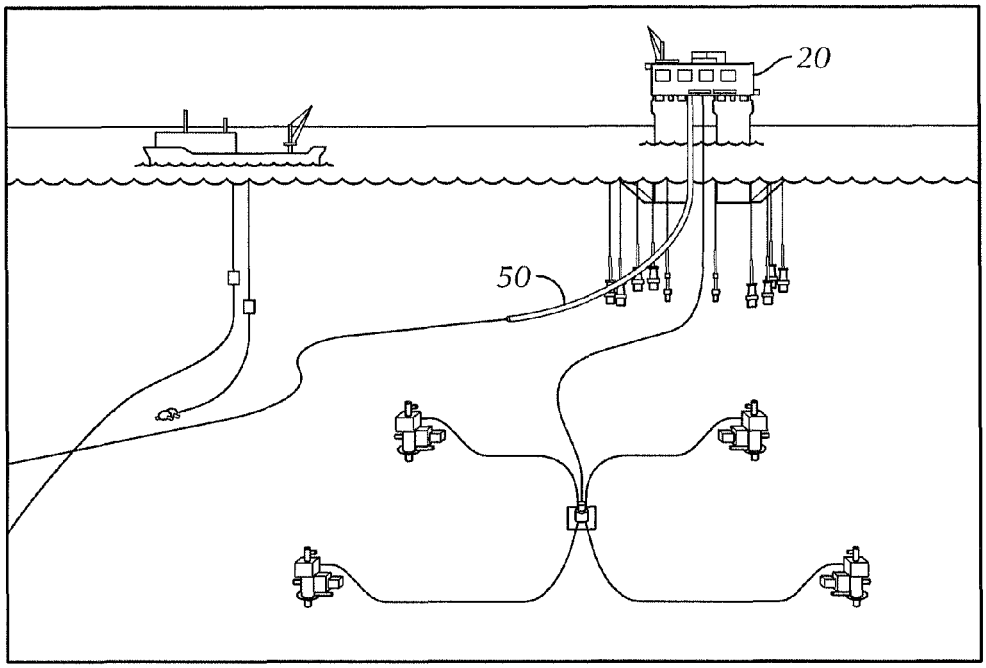
FIG. 1 shows a riser system in accordance with one or more embodiments of the present disclosure.

In one aspect, embodiments disclosed herein relate to a riser buoyancy module system providing buoyancy to a riser and platform while providing a conduit for a number of "intelligent" downhole services. Referring to FIG. 1, a riser buoyancy module system 50 in accordance with embodiments of the present disclosure is shown. A riser system 50 extends from an offshore platform 20 and has a string of multiple buoyancy modules attached thereto. The buoyancy modules are assembled around or coupled to the main riser and run along a length thereof from the surface down to the seafloor.

Figure 2:
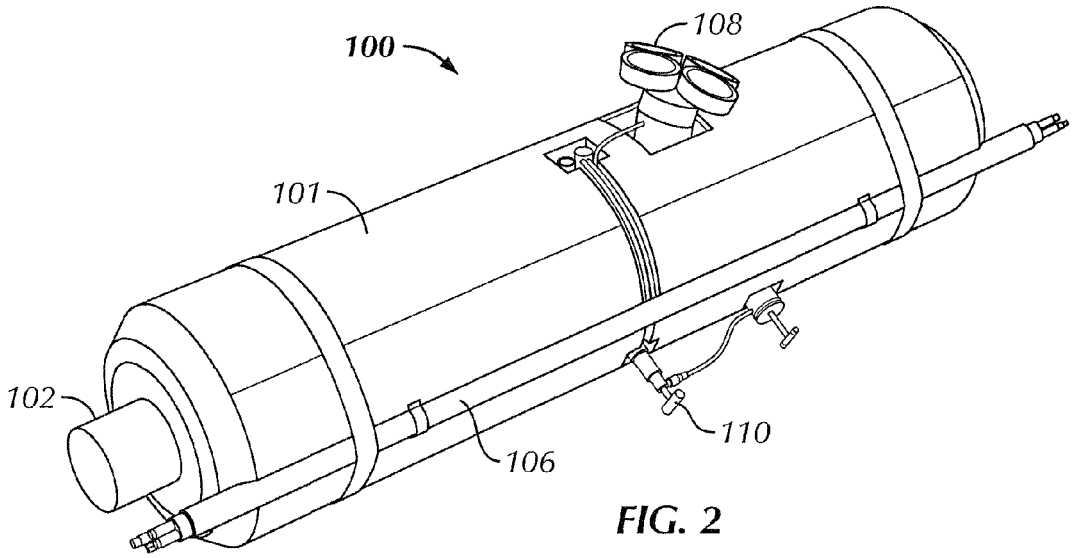
FIG. 2 shows a buoyancy module in accordance with one or more embodiments of the present disclosure.

A buoyancy module 100 is shown in FIG. 2. The buoyancy modules 100 may include an outer buoyant shell 101. In certain embodiments the outer buoyant shell 101 may be rotationally molded high density polypropylene ("HDPE"). Those skilled in the art will appreciate that other buoyant materials or configurations may be used for the buoyancy modules. For example, any type of buoyant syntactic foam material may be used in accordance with embodiments disclosed herein. Other configurations of buoyancy modules used may include "cans" which may be generally toroidal (i.e., doughnut-shaped) and slipped over the main riser, or may have evacuated buoyancy "cans" of other forms (e.g., closed-end cylinders) arranged in a circumferential array around the main riser conduit. Similarly, in certain embodiments, buoyancy cans may be connected to the surface by conduits so that water may be evacuated from the cans by high-pressure gas (such as compressed air or nitrogen) or by a buoyant slurry comprising, for example, glass microspheres.

Referring to FIG. 2, a perspective view of a buoyancy module 100 in accordance with embodiments of the present disclosure is shown. In one embodiment, the buoyancy module 100 may be about 14 feet long and may be capable of providing about 2,200 pounds of buoyancy (i.e., upward force) per module. In other embodiments, the buoyancy module 100 may be between about 5 feet and 20 feet long. Those skilled in the art will appreciate that the size of the buoyancy module may be varied to achieve different buoyancy.

Figure 3A:
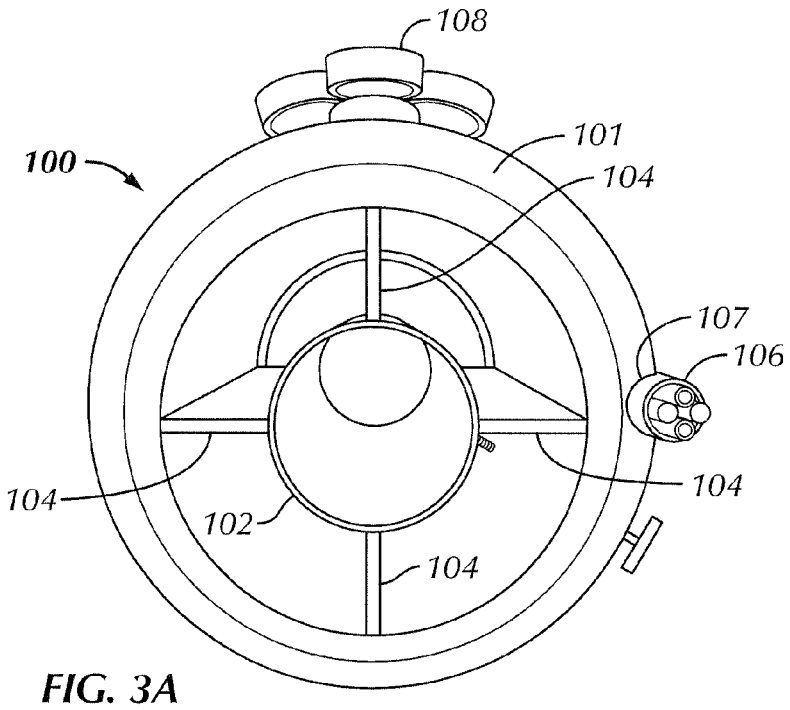
FIGS. 3A and 3B show cross-sectional views of the buoyancy module of FIG. 2.
Figure 3B:
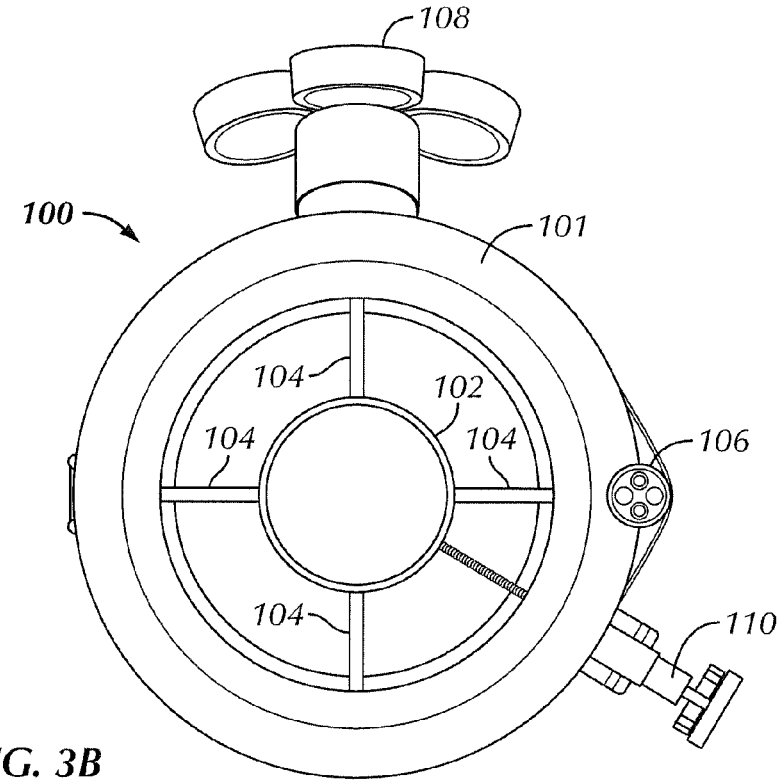

Referring to FIGS. 3A and 3B, cross-sectional views of the buoyancy module 100 in accordance with one or more embodiments of the present disclosure is shown. A center section 102 disposed within the outer shell 101 of the module 100 may be hollow and is centered within the shell 101 with two or more fins 104 running along a length of the center section 102. The hollow central channel of the center section 102 may be installed onto a riser. In other embodiments, the buoyancy module may include one or more inner chambers arranged internally in a number of various configurations. For example, the modules may have chambers (not shown) for both permanent syntactic foam and void space for air or water. The multiple chambers may be connected and monitored with metering valves or other equipment.

The buoyancy module 100 may also include a molded groove 107 formed in an outer surface of the buoyant shell 101, which runs along an entire length of the module 100. An umbilical 106 or other conduit may be run along a length of the buoyancy modules 100 in the molded groove 106. While only one molded groove 107 is shown, those skilled in the art will appreciate that any number of molded grooves may be included in the outer surface of the buoyant shell 101 for running multiple umbilicals 106 or conduits. In alternate embodiments, grooves for umbilicals may be formed in an inner surface of the buoyant shell 101 of the module 100. Likewise, in alternate embodiments, channels or other passageways may be formed within a wall of the buoyant shell 101 of the module 100. Various diameters and sizes of grooves or channels may be formed to accommodate various umbilical diameters. For example, a larger umbilical diameter may be required for additional individual communication lines running to multiple downhole components installed on the module 100.

Referring to FIGS. 2, 3A, and 3B together, in certain embodiments, the buoyancy module 100 may include an electrical actuated vent and air supply valve 108 configured to allow air to vent from or purge one or more chambers in the buoyancy module 100. Likewise, the valve 108 may allow water to fill the one or more chambers of the buoyancy module 100. For example, the buoyancy module 100 may have one or more orifices (not shown) in an outer surface to provide a fluid pathway from the one or more inner chambers to outside the module 100. Check valves or other one-way flow devices may be installed in the one or more orifices to prevent water outside the buoyancy modules 100 from entering the one or more chambers. Air or other fluids may be pumped into the buoyancy modules 100 through a solenoid valve (not shown) or other valve, thereby forcing a fluid within the buoyancy modules 100 out through the one or more orifices. In this manner, a buoyancy of the modules 100 may be controlled. The umbilical 106 may include individual lines (not shown) for air supply, power cable, and fiber optics that run along the molded groove with break out cables that run to the modules and their individual components. In addition, the buoyancy module 100 may include riser monitoring sensors 110 disposed in an outer surface thereof configured to monitor and indicate stress points along a length of the riser. The sensors 110 may be removable and/or serviceable by a remotely operated vehicle ("ROV").

A control system located at the surface is configured to communicate with the riser monitor sensors 110 to monitor a location of the stress concentration points and "touchdown" (i.e., where the riser first touches down on the seafloor) of the riser and may move water within the buoyancy modules by flooding and purging different buoyancy modules along a length of the riser, thereby moving the stress points and touchdown points. In response to indications of high stress points in specific points along the riser length, the buoyancy modules may include one or more pumps configured to displace water from within or into one or more inner chambers of the modules. For example, if a stress point is found at a particular location along a length of the main riser, the buoyancy of one or more modules disposed along the length thereof may be adjusted by filling or purging inner chambers of the modules as required, relieving the stress in the riser. In other embodiments, positioning of the riser may be adjusted by manipulating the buoyancy of one or more of the modules along the length of the riser. Still further, in alternate embodiments, the weight of the riser on the platform may be decreased by increasing the buoyancy of the modules to allow additional payload to be stored on the platform. In certain embodiments, automation software may be used to read and record the touchdown points, currents, and stresses on the risers. The information collected may be used to purge and flood various modules as required to move the touch down point and stress points.

In certain embodiments, the buoyancy modules may include acoustic Doppler current profiler units mounted thereon. An acoustic Doppler current profiler ("ADCP") is sonar equipment that produces a record of water current velocities for a range of depths. ADCP's may be made of ceramic materials, and may include transducers, an amplifier, a receiver, a mixer, an oscillator, a clock, a temperature sensor, a compass, a pitch and roll sensor, and computer components to save the information collected.

Still further, in certain embodiments, impressed current cathodic protection ("ICCP") systems may be integrated with the buoyancy modules to control corrosion of any metal surfaces. One or more anodes, connected to a DC or AC power source through the umbilical, may be disposed on the buoyancy modules. In alternate embodiments, alternative power sources for the ICCP system may be employed, including, but not limited to, surface solar panels, wind power, or gas powered thermoelectric generators. Those skilled in the art will appreciate any number of cathodic protection systems that may be used with the buoyancy modules in accordance with one or more embodiments of the present disclosure.

Advantageously, embodiments of the present disclosure provide a single system including multiple downhole components and configured to provide a base line of buoyancy to an entire riser, thus lowering the vertical load on the floating platform. As such, lowering the vertical load on the floating platform may reduce costs and provide more available payload on the floating platform for other equipment. In addition, a fatigue life of the riser is increased and potential wall thickness of the riser pipe is reduced by being able to control the stresses and touchdown points on multiple risers simultaneously. The ability to move the touchdown point of the riser with buoyancy modules also simplifies the drilling and production operations by eliminating having to move the floating platform itself to multiple locations in order to move the touchdown points and reduce stresses. Further, the buoyancy system disclosed in embodiments herein provides the ability for an ROV to remove and install riser monitor sensors subsea, the riser monitor sensors used to detect stress points along a length of the riser. Finally, the buoyancy system provides a safe way to carry an umbilical needed to power and control all downhole devices at a fraction of the cost and space required normally.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A marine riser comprising:

two buoyancy modules running along a length of the marine riser, each buoyancy module including:

an outer buoyant shell;

one or more chambers within the outer buoyant shell;

a groove molded in an outer surface of the outer buoyant shell and positioned along a length thereof;

an umbilical secured in the molded groove along a length thereof, wherein the umbilical provides air or water to enter the one or more chambers such that a first buoyancy module has a first buoyancy and a second buoyancy module has a second buoyancy different from the first buoyancy; and at least one riser monitoring sensor disposed on an outer circumference of the outer buoyant shell and configured to indicate stress points.

2. The marine riser of claim 1, wherein a buoyancy of the two buoyancy modules is adjustable along a length of the riser.

3. The marine riser of claim 1, wherein the two buoyancy modules further comprise a supply valve configured to allow air and water enter the one or more inner chambers.

4. The marine riser of claim 1, wherein the two buoyancy modules further comprise one or more orifices configured to allow air and water to exit the one or more inner chambers.

5. The marine riser of claim 1, wherein each buoyancy module is operatively coupled to a riser monitoring system configured to indicate stress points along a length of the riser.

6. A marine riser comprising:

a riser monitoring system configured to indicate stress points along, a length of the marine riser;

at least one buoyancy module including:

an outer buoyant shell;

one or more inner chambers within the outer buoyant shell; and a supply valve that allows air or water to enter the one or more inner chambers in response to indicated stress points along the length of the marine riser.

7. The marine riser of claim 6, further comprising a center section disposed within the outer buoyant Shell and centered with multiple outer fins, wherein the center section comprises a hollow central bore.

8. The marine riser of claim 6, further comprising at least one molded groove formed in an outer surface of the outer buoyant shell along a length thereof and configured to correspond with a conduit.

9. The marine riser of claim 6, wherein the outer buoyant shell comprises molded polypropylene.

10. the marine riser of claim 6, further comprising an acoustic Doppler current profiler.

11. The marine riser of claim 6,. further comprising a cathodic protection system.

12. A method comprising:

installing one or more buoyancy modules along a length of a subsea riser;

monitoring a location of stress concentration points along the riser;

providing communication to one or more downhole components installed on the one or more buoyancy modules through an umbilical running along a length of the one or more buoyancy modules; and adjusting a buoyancy of at least one of the one or more buoyancy modules to move the stress concentration points.

13. The method of claim 12, further comprising monitoring touchdown points of the subsea riser and adjusting a buoyancy of the one or more buoyancy modules to move touchdown points of the subsea riser.

14. The method of claim 12, wherein the adjusting further comprises displacing water or air within the one or more buoyancy modules.

15. The method of claim 12, further comprising opening at least one of an electrically actuated supply valve connected to an air supply or an electrically actuated vent with a riser monitoring system.

16. The method of claim 12, further comprising opening at least one of a supply valve, connected to an air supply or a vent with a remotely operated vehicle.

17. The method of claim 12, further comprising adjusting a position of the riser by adjusting the buoyancy of the one or more modules.

18. The marine riser of claim 12, wherein the monitoring further comprises reading and recording at least one of the group consisting of the location of stress concentration points, the location of touchdown points, and currents along the marine riser to determine how to adjust the buoyancy of the one or more buoyancy modules to move the stress concentration points.

19. The marine riser of claim 1, wherein the at least one riser monitoring sensor is positioned such that the sensor is serviceable and/or removable by an ROV.

20. The marine riser of claim 1, wherein the outer buoyant shell includes two or more chambers, and wherein the marine riser further comprises a pump to displace water between the two or more chambers.

* * * * *